US008764228B2

(12) United States Patent
Lo et al.

(10) Patent No.: US 8,764,228 B2
(45) Date of Patent: Jul. 1, 2014

(54) ILLUMINATION DEVICE, LIGHT SOURCE, AND LIGHT MODULE

(75) Inventors: Hsin-Hsiang Lo, Hsinchu County (TW); Chun-Chuan Lin, Hsinchu (TW); Kuo-Tung Tiao, Hsinchu County (TW); Chao-We Li, Hsinchu (TW); Hung-Lieh Hu, Hsinchu (TW); Chen-Kun Chen, Changhua County (TW)

(73) Assignee: Industrial Technology Research Institute, Hsinchu (TW)

( * ) Notice: Subject to any disclaimer, the term of this patent is extended or adjusted under 35 U.S.C. 154(b) by 298 days.

(21) Appl. No.: 13/410,310

(22) Filed: Mar. 2, 2012

(65) Prior Publication Data

US 2013/0114252 A1 May 9, 2013

Related U.S. Application Data

(60) Provisional application No. 61/557,352, filed on Nov. 8, 2011.

(51) Int. Cl.
*F21V 11/14* (2006.01)
*F21V 11/08* (2006.01)

(52) U.S. Cl.
USPC ..... 362/235; 362/236; 362/240; 362/618

(58) Field of Classification Search
CPC ..... F21K 9/00; F21K 9/58; F21K 9/135; H05B 33/02; F21V 1/00; F21V 3/00; F21V 3/02; F21V 3/0472; F21V 11/08; F21V 11/10; F21V 11/12; F21V 11/14
USPC ..... 362/235–248, 615–619, 627; 313/110–117
See application file for complete search history.

(56) References Cited

U.S. PATENT DOCUMENTS 6,709,132 B2 3/2004 Ishibashi
6,979,112 B2 * 12/2005 Yu et al. ..... 362/600

(Continued)

FOREIGN PATENT DOCUMENTS

| | | |
|---|---|---|
| CN | 101730821 | 6/2010 |
| CN | 201973495 | 9/2011 |
| TW | 200626830 | 8/2006 |
| TW | 200848661 | 12/2008 |

OTHER PUBLICATIONS

Xiaobing Luo et al., "Thermal Design of a 16W LED Bulb Based on Thermal Analysis of a 4W LED Bulb", 2010 Electronic Components and Technology Conference, Jun. 2010, pp. 1906-1911.
Nadarajah Narendran, "Is solid-state lighting ready for the incandescent lamp phase-out?", Proc. of SPIE, vol. 8123, Aug. 2011, pp. 812302-1-812302-8.
Haiyan Ou et al., "'No blue' LED solution for photolithography room illumination", Proc. of SPIE vol. 7617, Jan. 2010, pp. 76170Z-1-76170Z-7.

*Primary Examiner* — Karabi Guharay
*Assistant Examiner* — Nathaniel Lee
(74) *Attorney, Agent, or Firm* — Jianq Chyun IP Office

(57) ABSTRACT

An illumination device including a base, a light bar, and a cover is provided. The base has a cavity. The light bar is disposed at the bottom of the cavity and includes a plurality of dot light sources arranged along a first axial direction. The cover is assembled to the base for correspondingly covering the light bar and has a plurality of openings. The distribution density of the openings increases from a corresponding location of a dot light source towards two opposite ends along the first axial direction. A light source and a light module are also provided. Another illumination device including a base and a plurality of light sources is further provided.

40 Claims, 6 Drawing Sheets

(56) References Cited

U.S. PATENT DOCUMENTS

| | | | | |
|---|---|---|---|---|
| 7,086,756 | B2 | 8/2006 | Maxik | |
| 7,185,995 | B2 * | 3/2007 | Hatanaka et al. | 362/29 |
| 7,819,542 | B2 | 10/2010 | Sato | |
| 2005/0174769 | A1 | 8/2005 | Yong et al. | |
| 2008/0239751 | A1 * | 10/2008 | Chang | 362/612 |
| 2009/0231847 | A1 | 9/2009 | Pan et al. | |
| 2010/0181591 | A1 | 7/2010 | Suzuki | |

* cited by examiner

ILLUMINATION DEVICE, LIGHT SOURCE, AND LIGHT MODULE

CROSS-REFERENCE TO RELATED APPLICATION

This application claims the priority benefit of U.S. provisional application Ser. No. 61/557,352, filed on Nov. 8, 2011. The entirety of the above-mentioned patent application is hereby incorporated by reference herein and made a part of this specification.

TECHNICAL FIELD

The technical field relates to an illumination device, a light source, and a light module, and in particular to a Light-Emitting Diode application.

BACKGROUND

Light-Emitting Diodes (LED) are semiconductor components. The materials of the light-emitting chips are mainly chemical compounds of groups III-V, such as gallium phosphide (GaP) or gallium arsenide (GaAs), and are capable of converting electrical energy into optical energy. The lifespan of LEDs is more than a hundred thousand hours, and LEDs have quick response, small size, low power consumption, low pollution, high reliability, and are suitable for mass production.

With increasing demands for energy conservation and environmental protection, it has become a trend worldwide for people to use LEDs to construct lighting devices for use in daily life. In common practice, LEDs are usually installed on a carrier (e.g. a printed circuit board) to become an illumination device.

Nevertheless, LEDs produce a lot of heat at the same time as producing light. Therefore, the heat generated by the LEDs among the abovementioned lighting components is often unable to be effectively dissipated to the exterior, thus resulting in reduction of device performance. As a result, concurrently achieving both light source illumination and heat dissipation efficiency in order to enhance the reliability of LEDs has become an essential topic.

SUMMARY

The disclosure provides an illumination device, a light source and a light module having concurrently both enhanced illumination and enhanced heat dissipation efficiency.

According to one exemplary embodiment, an illumination device comprises a base, a light bar and a cover. The base has a cavity. The light bar is disposed at the bottom of the cavity. The light bar comprises a plurality of dot light sources arranged along a first axial direction. The cover is assembled to the base for correspondingly covering the light bar. The cover has a plurality of openings, and the distribution density of the openings increases from a corresponding location of a dot light source towards two opposite ends along the first axial direction.

According to one exemplary embodiment, a light source comprises a light bar and a cover. The light bar comprises a plurality of dot light sources arranged along a first axial direction. The cover covers the light bar. The cover has a plurality of openings, and the distribution density of the openings increases from a corresponding location of a dot light source towards two opposite ends along the first axial direction.

According to one exemplary embodiment, a light module comprises a plurality of light bars arranged along a second axial direction and a cover correspondingly covering the light bars. Each of the light bars comprises a plurality of dot light sources arranged along a first axial direction. The cover has a plurality of openings, and the distribution density of the openings increases from a corresponding location of a dot light source towards two opposite ends along the first axial direction.

According to one exemplary embodiment, an illumination device comprises a base and a plurality of light sources. The base has a central axial direction and a plurality of cavities surrounding the arranged central axial direction. The light sources are disposed separately at the cavities. Each of the light sources comprises a light bar and a cover. The light bar is located at the bottom of the corresponding cavity, and the light bar comprises a plurality of dot light sources. The cover is assembled to the base for covering the cavity and the light bar inside the cavity. The cover has a plurality of openings, and the distribution density of the openings increases when going from a corresponding location of a dot light source towards an adjacent dot light source location.

Based on the above, in another exemplary embodiment, the light source, the light module and the illumination device use the cover with a plurality of openings to cover the light bar, so as to enable the light of the dot light source to emit out of the cover in a more uniform manner. Furthermore, heat generated by the dot light source can also be dissipated effectively with the presence of these openings, thus improving the reliability of the dot light source. Therefore, the light source, the light module and the illumination device concurrently have enhanced illumination and enhanced heat dissipation efficiency.

Several exemplary embodiments accompanied with figures are described in detail below to further describe the disclosure in details.

DESCRIPTION OF EMBODIMENTS

Figure 1:
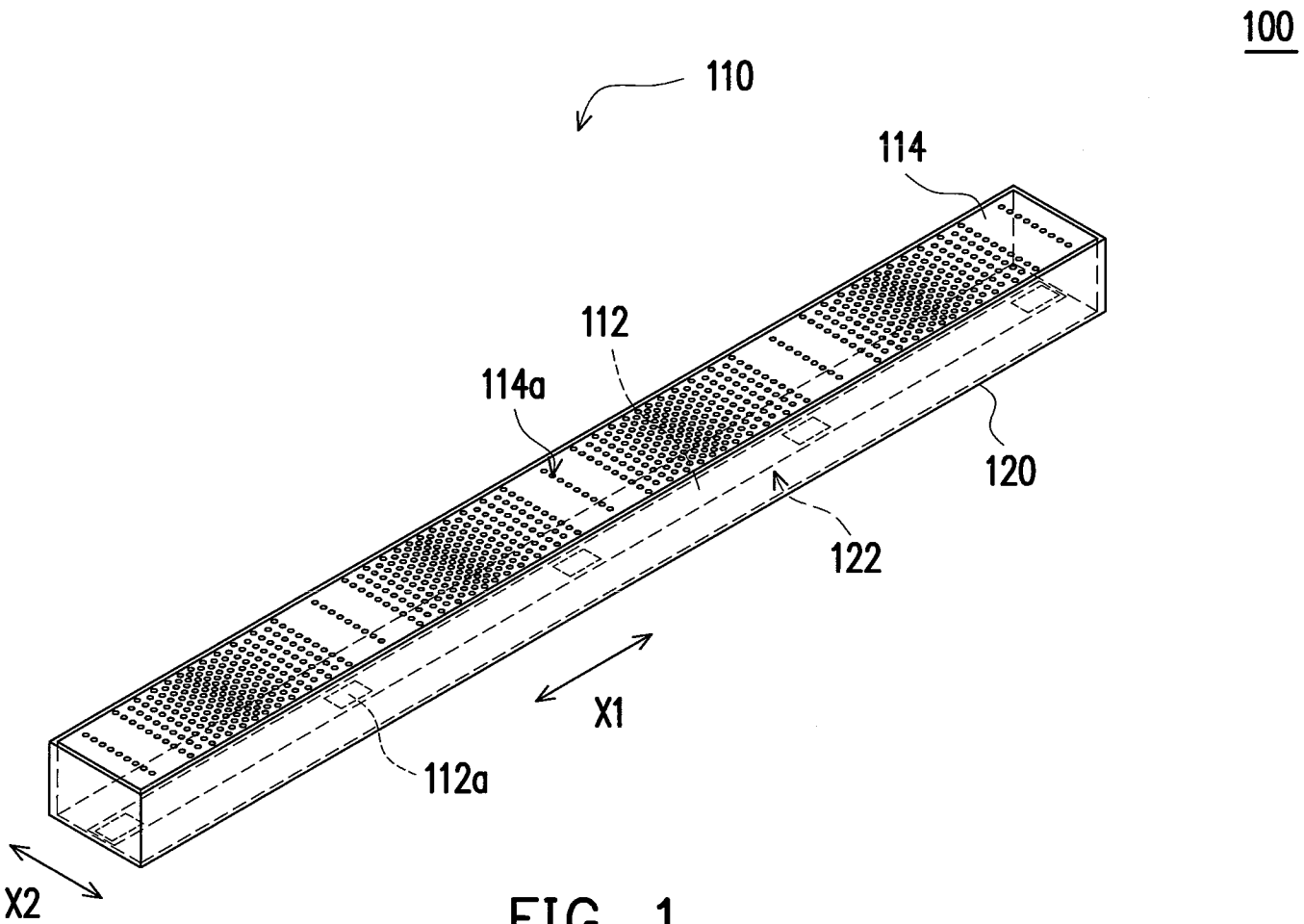
FIG. 1 is a schematic diagram illustrating an illumination device in accordance with one exemplary embodiment.

FIG. 1 is a schematic diagram illustrating an illumination device in accordance with one exemplary embodiment. Referring to FIG. 1, the illumination device 100 comprises a light source 110 and a base 120 for holding the light source 110. The base 120 has a strip-shaped cavity 122. The light source 110 comprises a light bar 112 and a cover 114. The light bar 112 is disposed at the bottom of the cavity 122, and the light bar 112 comprises a plurality of dot light sources 112*a* arranged along a first axial direction X1. Herein, the light bar 112 is formed by configuring Light-Emitting Diodes on flexible printed circuit board, but it is not limited hereto.

The cover 114 is assembled to the base 120 for correspondingly covering the cavity 122 and the light bar 112 inside the cavity 122. The cover 114 has a plurality of openings 114*a*, so as to enable the light emitted by the dot light source 112*a* to penetrate through the cover 114. The distribution density of the openings 114*a* increases from a corresponding location of a dot light source 112*a* towards two opposite ends along the first axial direction X1. The non-opening region of the cover 114, which corresponds to the surface of the dot light source 112*a*, has a reflective diffusion material layer for reflecting or scattering the light emitted by the dot light source 112*a* back into the cavity. Moreover, the interior wall of the cavity 122 also has the reflective diffusion material layer for re-scattering out some of the light reflected or scattered back into the cavity 122 by the cover 114, and thus the light is reflected or scattered back and forth within the cavity 122, so as to enable some of the light to transport out of the illumination device 100 through the openings 114*a*.

Figure 2:
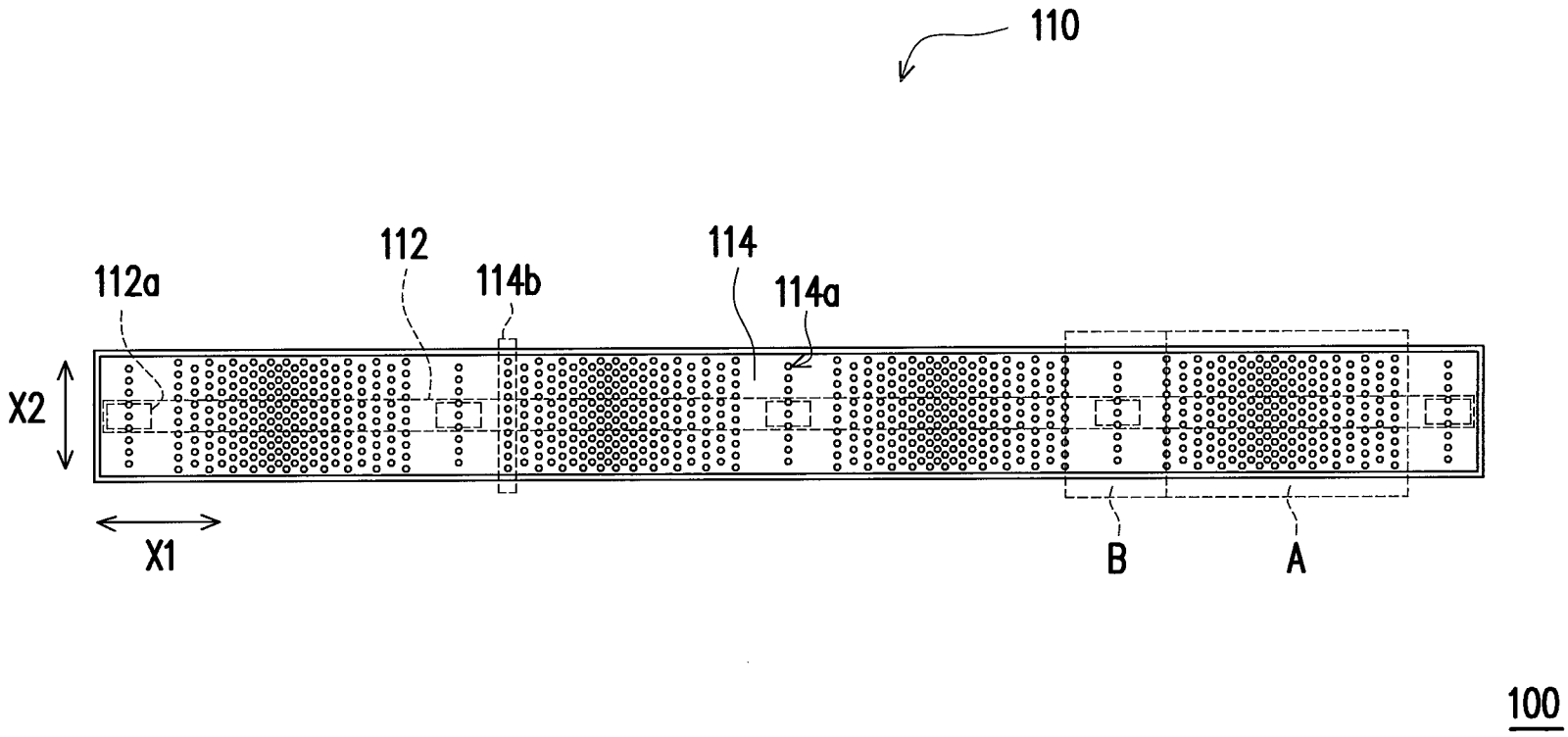
FIG. 2 is a top view diagram of the illumination device in FIG. 1.

FIG. 2 is a top view diagram of the illumination device in FIG. 1. Referring to both FIGS. 1 and 2, when the cover 114 correspondingly covers the light bar 112, the predetermined relationship between the openings 114*a* and the dot light sources 112*a* beneath is also established. In an embodiment, the distribution density of the openings 114*a* on a second axial direction X2 is constant, while the distribution density on the first axial direction X1 is distributed as sparse-dense-sparse-dense according to the previous description. The openings 114*a* can be considered as a plurality of opening strips 114*b* extended along the second axial direction X2 and arranged along the first axial direction X1, wherein the first axial direction X1 is substantially perpendicular to the second axial direction X2.

In further detail, the relationship between the distribution of the opening strips 114*b* and the dot light sources 112*a* at the bottom of the cavity 122 is described as below:

$$p_i=(i/1)^{gamma}\times(h/2)|_{i=0-1},$$

wherein i is the normalized variable of the opening strips, h is the spacing value of the dot light source, gamma is the locational modulation coefficient, and $p_i$ is the location of each corresponding opening and dot light source.

Accordingly, the density distribution of the opening strips 114*b*, on the cover 114, directly above the dot light sources 112*a* is at the minimum, as shown in FIG. 2, as only one opening strip 114*b* is directly opposite the dot light source 112*a*, but the embodiment is not limited thereto. Correspondingly, the density distribution of the opening strip 114*b* on the cover 114 corresponding to the center between the two adjacent dot light sources 112*a* is at the maximum.

If the openings 114*a* of the cover 114 are approximately divided into region A and region B, on the first axial direction X1, the distribution density of the opening in region A would be greater than the distribution density of the opening in region B. Therefore, based on the above relation, when disposing the dot light sources 112*a* at the bottom of the cavity 122, the dot light sources 112*a* have to be disposed in the region B.

The distribution density of the openings 114*a* on the cover 114 directly opposite the dot light sources 112*a*, is less than the distribution density of the openings 114*a* along either side of the dot light sources along first axial direction X1, hence the light exit on the cover 114 is less, thus reducing the light concentration therein. Correspondingly, the distribution density of the openings 114*a* on the cover 114, corresponding to the center between two adjacent dot light sources 112*a*, is at the maximum, thus enhancing the light exit therein. Based on the above, the light generated by the dot light sources 112*a* would not completely emit through the cover 114 due to excessive openings 114*a* directly opposite the dot light sources 112*a*. However, the distribution density of the openings 114*a* not directly opposite the dot light sources 112*a* is greater than the distribution density of the opening 114*a* directly opposite the dot light source 112*a*, thus balancing the light exit in order to form the strip-shaped illumination device 100 capable of uniformly emitting light. As an additional indication, the term "directly opposite" mentioned above means that the dot light sources 112*a* are directly projecting onto the location of the cover 114.

Figure 4:
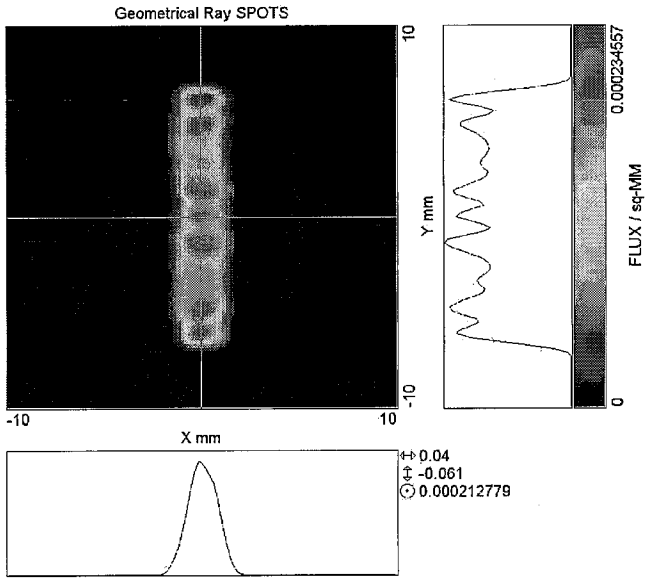
FIG. 4 is an analytical illuminance diagram of the proposed illumination device in accordance with one exemplary embodiment.
Figure 3:
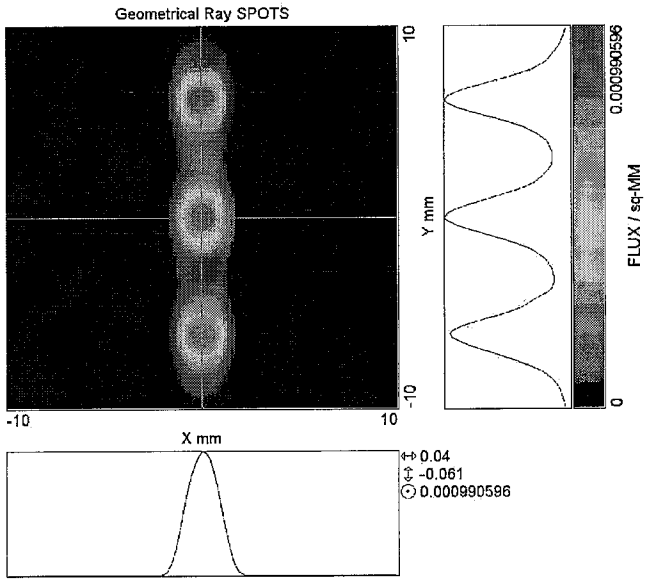
FIG. 3 is an analytical illuminance diagram of the conventional illumination device.

FIG. 3 and FIG. 4 are respectively the analytical illuminance diagrams of a conventional and the proposed illumination device, wherein the conventional illumination device does not include the configuration of the proposed openings. Referring to both FIG. 3 and FIG. 4, the conventional illumination device achieves uniform illumination by placing a diffusion sheet at the outlet of the cavity, and when the height of the cavity is reduced then a bright and dark distribution between the dot light sources is prone to be produced. However, the proposed illumination device achieves uniform illumination through the density arrangement of the openings 114*a*. In one embodiment, when the height and the width of the cavity 122 are 1 mm and 2.4 mm, the spacing of the dot light sources h is 5.23 mm, and the gamma equals to 0.8, the illumination device 100 is able to output a more uniform illuminance distribution.

In an embodiment, the cover 114 is white reflective sheet or another reflective material capable of reflecting or scattering back the light. Furthermore, the interior wall of the base 120 also has a reflective diffusion material layer. This enables the illumination device 100 to enhance the efficiency of the dot light sources 112*a* inside of the cavity 122, emitting out of the cover 114 by reflecting or scattering through the openings 114*a*.

Figure 5:
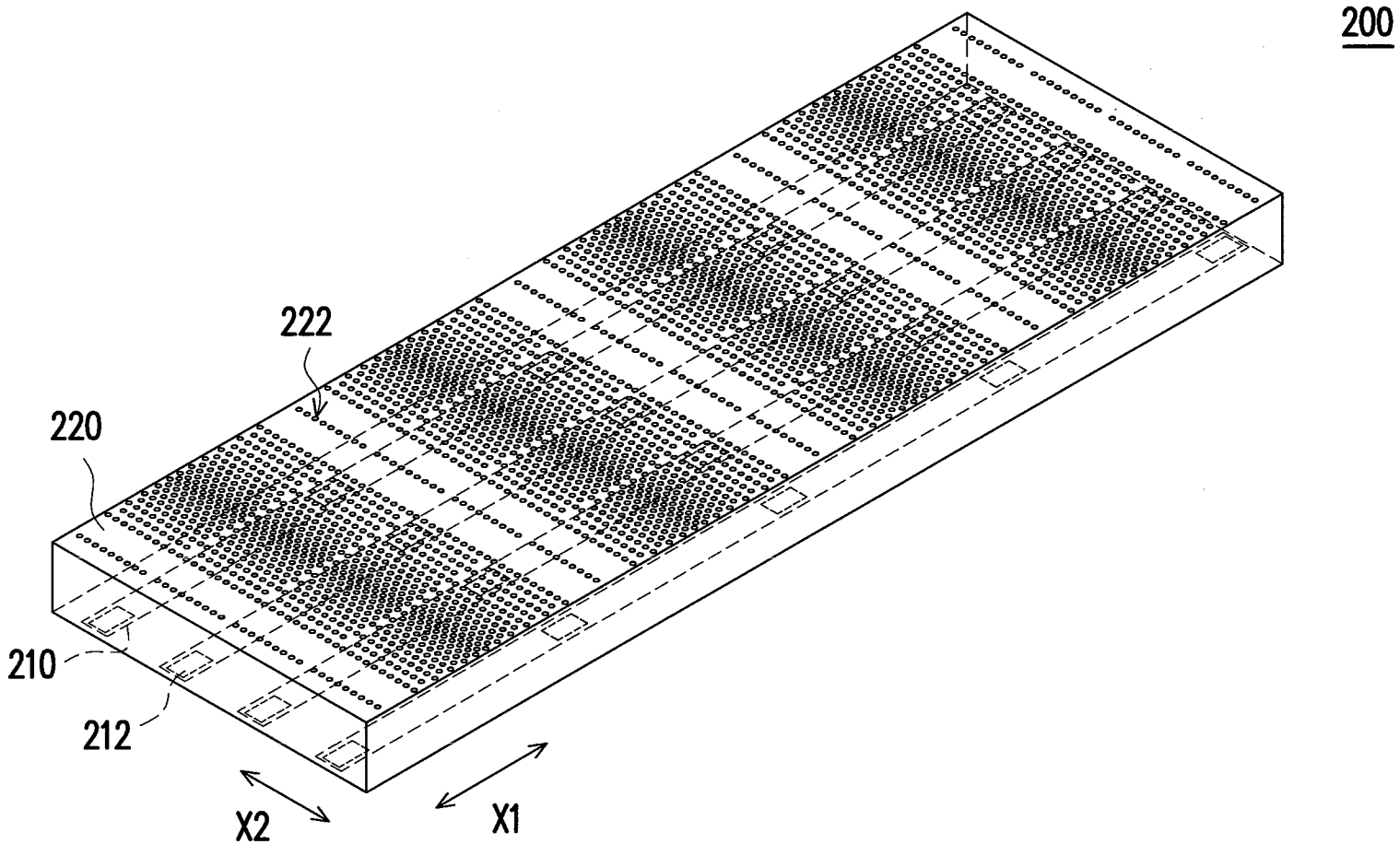
FIG. 5 is a schematic diagram illustrating a light module in accordance with one exemplary embodiment.

FIG. 5 is a schematic diagram illustrating a light module in accordance with one exemplary embodiment. The light module 200 of this embodiment comprises a plurality of light bars 210 and a cover 220, wherein the light bars 210 are arranged along a second axial direction X2, and each of the light bars 210 comprises a plurality of dot light sources 212 arranged along a first axial direction X1. The cover 220 covers the light bars 210. The cover 220 has a plurality of openings 222, and the distribution density of the openings 222 increases from a corresponding location of a dot light source 212 towards two ends along the first axial direction X1.

The effect this embodiment produces is similar to arranging the light source 110 in FIG. 1 along the second axial direction X2, thus evolving from the original one-dimensional linear arrangement of light source 110 to a two-dimensional matrix light module 200. The openings 222 on the cover 220 in this embodiment are still the same as in the previous embodiments, and its distribution density on the first axial direction X1 initially increases then decreases from a corresponding location of a dot light source 212 towards an adjacent dot light source location 212, so as to let this embodiment to achieve the same effect.

Figure 6:
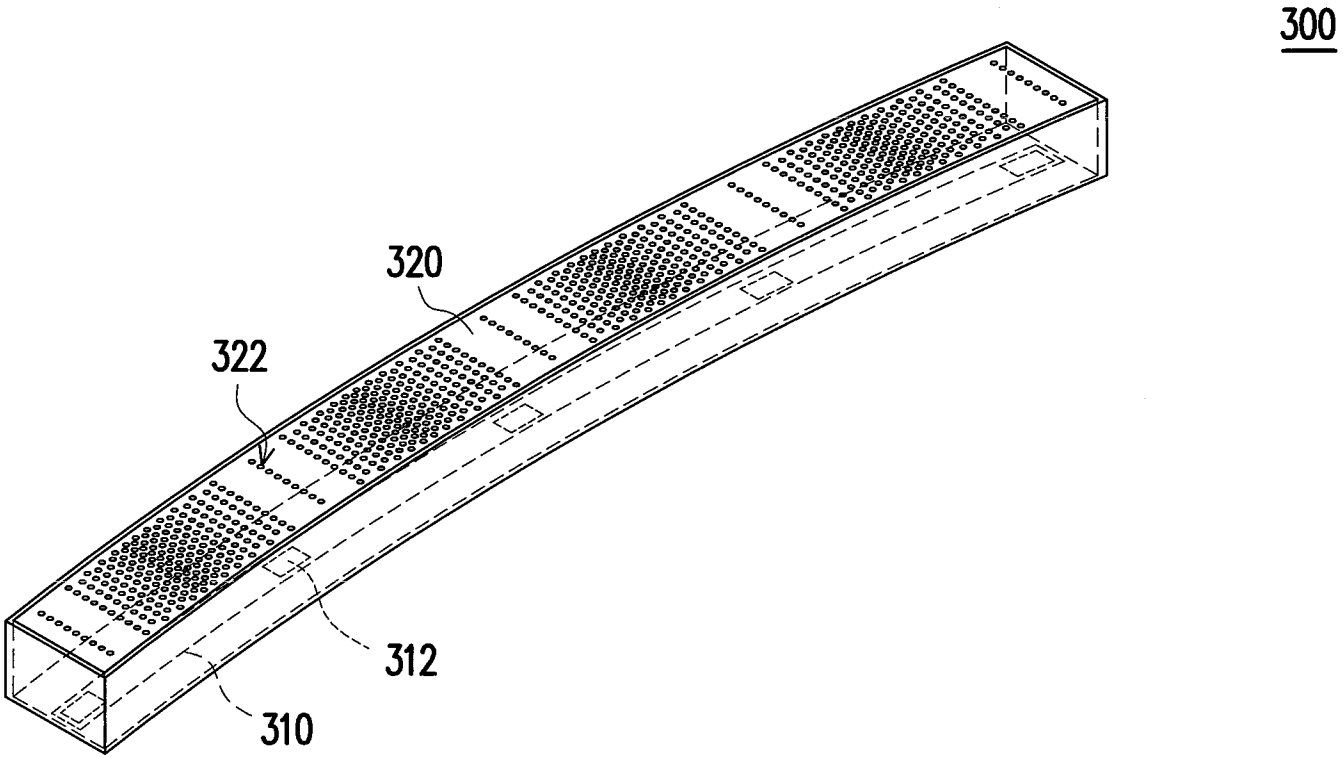
FIG. 6 is a schematic diagram illustrating a light module in accordance with one exemplary embodiment.

FIG. 6 is a schematic diagram illustrating a light source in accordance with another exemplary embodiment. Apart from the previous embodiments, the light bar 310 and the cover 320 of the light source 300 both have flexibility, wherein the light bar 310 configures the dot light sources 312 on the flexible printed circuit board for instance, so as to configure the light bar 310 to correspond to the surface profile of the combining components.

Accordingly, the light source 300 is able to have a curved plate-shape as shown in FIG. 6, and each of the dot light sources 312 maintains a fixed distance relative to the cover 320. Thus when the light source 300 is in a curved plate-shape, the relationship between the dot light source 312 corresponding to the openings 322 on the cover 32 can be determined by adjusting the gamma coefficient and the attainable uniform illumination effect depending on the curve degree.

Figure 7:
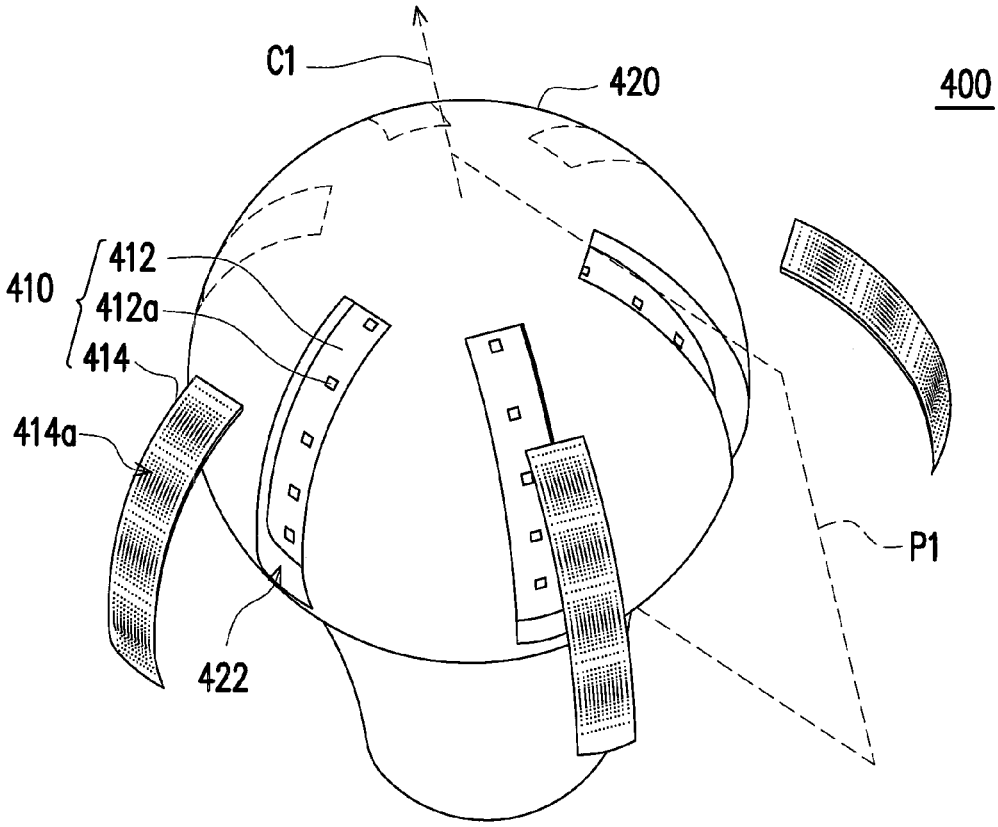
FIG. 7 is an assembly schematic diagram illustrating an illumination device in accordance with one exemplary embodiment.
Figure 8:
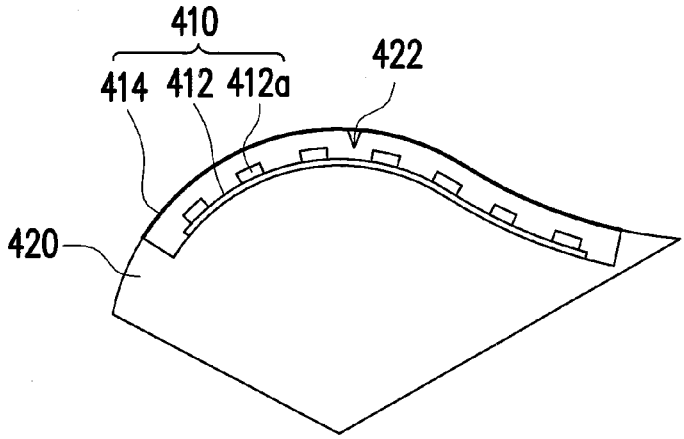
FIG. 8 is a partial cross-sectional schematic diagram of the illumination device along a plane P1 in FIG. 7.

FIG. 7 is an assembly schematic diagram illustrating an illumination device in accordance with one exemplary embodiment. FIG. 8 is a partial cross-sectional schematic diagram of the illumination device along a plane P1 in FIG. 7. Referring to FIG. 7 and FIG. 8, the illumination device 400 uses the light sources 300 shown in FIG. 6. In the embodiment, the illumination device 400 has a spherical bulb appearance, which comprises a plurality of light sources 410 (only one is labeled) and a base 420. Each of the light sources 410 comprises a light bar 412 and a cover 414, and the cover 414 has been configured with a plurality of openings 414*a* similar to the previous embodiments (the openings are not illustrated in FIG. 8 due to proportion), wherein the density of the openings 414*a* on the cover 414 increases, decreases and increases along the central axial direction C1 of the base 420 towards the two ends in order to create the same sparse-dense-sparse-dense distribution as in the previous embodiments.

Furthermore, the base 420 is integrally formed of thermal conductive plastic for instance, or is formed of metal with good thermal conductivity, so the light bar 412 configured on it is able to dissipate heat. In addition, when the base 420 is constructed or turning processed to encompass a multiple-curved strip-shaped form relative to the circularly arranged cavities 422 of the central axial direction C1, such as shown in FIG. 7 (e.g. FIG. 7 illustrates the structure of arc-shaped gaps, and the extension direction of each of the arc-shaped gaps is consistent with the central axial direction C1), the light bar 412 disposed inside of the cavities 422 also encompass the curved strip-shaped form, and the extension direction of the light bar 412 along with the arrangement direction of the dot light sources 412*a* is consistent with the central axial direction C1. The cover 414 shares an identical surface profile with the base 420 after its assembly to the base 420. At the same time, the reflective diffusion material layer is also disposed on the cavities 422 for reflecting light out of the cavities 422 through the openings 414*a* on the cover 414.

Accordingly, a lighting effect similar to the conventional light bulb can be generated when the light source 410 is disposed inside of the cavities 422 of the base 420. Moreover, through the distribution of the openings 414*a* on the cover 414, the brightness and illuminance uniformity and effectiveness of the illumination device 400 can be further enhanced.

The light source in the abovementioned embodiments is not limited to the strip-shaped, plate-shaped, or curved strip-shaped form. The number of the light sources is also not limited, under the condition that the relationship between the dot light source and the openings on the cover is satisfied, and users can appropriately adjust the number according to the application environment or lighting style.

In general, by using the cover with a plurality of openings to cover the light bar, the light source, the light module and the illumination device are able to emit the light of the dot light sources out of the cover in a more uniform manner. Furthermore, with the presence of the openings, the heat generated by the dot light source is able to be dissipated effectively, thus improving the reliability of the dot light source, and further concurrently enhancing the illumination and heat dissipation efficiency of the light source, the light module and the illumination device.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. An illumination device comprising:

a base having a cavity;

a light bar disposing at the bottom of the cavity, wherein the light bar comprises a plurality of dot light sources arranged along a first axial direction; and a cover assembling to the base for correspondingly covering the light bar, wherein the cover has a plurality of openings, and the distribution density of the openings increases from a corresponding location of a dot light source towards two opposite ends along the first axial direction.

2. The illumination device as claimed in claim 1, wherein some of the openings directly opposite the dot light sources.

3. The illumination device as claimed in claim 1, wherein the distribution density of the openings are fixed along a second axial direction, and the first axial direction is substantially perpendicular to the second axial direction.

4. The illumination device as claimed in claim 1, $$p_i=(i/1)^{gamma}\times(h/2)|_{i=0\sim1},$$

wherein i is the normalized variable of the openings' arrangement number along the first axial direction, h is the spacing value of the dot light source, gamma is the locational modulation coefficient, and $p_i$ is the location of each corresponding opening and dot light source.

5. The illumination device as claimed in claim 1, wherein the cover is made of reflective diffusion material.

6. The illumination device as claimed in claim 1, wherein an interior wall of the base contains reflective diffusion material layer.

7. The illumination device as claimed in claim 1, wherein the cavity is strip-shaped or plate-shaped.

8. The illumination device as claimed in claim 7, wherein the openings have the same size.

9. The illumination device as claimed in claim 7, wherein the cavity is curved strip-shaped or curved plate-shaped, and the cover maintains a fixed distance relative to the bottom of the cavity.

10. The illumination device as claimed in claim 9, wherein the base and the cover have flexibility.

11. A light source comprising:

a light bar comprises a plurality of dot light sources of a first axial direction; and a cover covering the light bar, wherein the cover has a plurality of openings, and the distribution density of the openings increases from a corresponding location of a dot light source towards two opposite ends along the first axial direction.

12. The light source as claimed in claim 11, wherein parts of the openings directly opposite the dot light sources.

13. The light source as claimed in claim 11, wherein the distribution density of the openings are fixed along a second axial direction, and the first axial direction is substantially perpendicular to the second axial direction.

14. The light source as claimed in claim 11, $$p_i=(i/1)^{gamma}\times(h/2)|_{i=0-1},$$

wherein i is the normalized variable of the openings' arrangement number along the first axial direction, h is the spacing value of the dot light source, gamma is the locational modulation coefficient, and $p_i$ is the location of each corresponding opening and dot light source.

15. The light source as claimed in claim 11, wherein the cover is made of reflective diffusion material.

16. The light source as claimed in claim 11, wherein the cover is strip-shaped, and each of the dot light sources maintains a fixed distance relative to the cover.

17. The light source as claimed in claim 16, wherein the openings have the same size.

18. The light source as claimed in claim 11, wherein the cover is curved strip-shaped, and each of the dot light sources maintains a fixed distance relative to the cover.

19. The light source as claimed in claim 18, wherein the cover has flexibility.

20. A light module comprising:

a plurality of light bars arranged along a second axial direction, and each of the light bars comprises a plurality of dot light sources of a first axial direction; and a cover covering the light bars, wherein the cover has a plurality of openings, and the distribution density of the openings increases from a corresponding location of a dot light source towards two opposite ends along the first axial direction.

21. The light module as claimed in claim 20, wherein the distribution density of the openings on the first axial direction initially increases then decreases from a corresponding location of a dot light source towards another location of an adjacent dot light source.

22. The light module as claimed in claim 20, wherein parts of the openings are directly opposite the dot light sources.

23. The light module as claimed in claim 20, wherein the distribution density of the openings are fixed along a second axial direction, and the first axial direction is substantially perpendicular to the second axial direction.

24. The light module as claimed in claim 20, $$p_i=(i/1)^{gamma}\times(h/2)|_{i=0-1},$$

wherein i is the normalized variable of the openings' arrangement number along the first axial direction, h is the spacing value of the dot light source, gamma is the locational modulation coefficient, and $p_i$ is the location of each corresponding opening and dot light source.

25. The light module as claimed in claim 20, wherein the cover is made of reflective diffusion material.

26. The light module as claimed in claim 20, wherein the cover is plate-shaped, and each of the dot light sources maintains a fixed distance relative to the cover.

27. The light module as claimed in claim 26, wherein the openings have the same size.

28. The light module as claimed in claim 20, wherein the cover is curved plate-shaped, and each of the dot light sources maintains a fixed distance relative to the cover.

29. The light module as claimed in claim 28, wherein the cover has flexibility.

30. An illumination device comprising:

a base having a central axial direction and a plurality of cavities surrounding the arranged central axial direction;

a plurality of light sources disposing separately on the cavities, wherein each of the light sources comprises:

a light bar locating in the corresponding cavity, and the light bar comprises a plurality of dot light sources; and a cover assembling to the base for covering the cavity and the light bar inside of the cavity, wherein the cover has a plurality of openings, and the distribution density of the openings increases from a corresponding location of a dot light source towards another location of an adjacent dot light source.

31. The illumination device as claimed in claim 30, wherein the base is a spherical bulb base, each of the cavities is an arc-shaped gap on the spherical bulb base, and each of the covers is curved strip-shaped, so the cover and the base having an identical surface profile after the cover is assembled to the base.

32. The illumination device as claimed in claim 31, wherein the extension direction of each of the arc-shaped gap, the extension direction of the light bar, and the orientation of the dot light sources are all consistent with the central axial direction.

33. The illumination device as claimed in claim 30, wherein parts of the openings are directly opposite the dot light sources.

34. The illumination device as claimed in claim 30, wherein the distribution density of the openings increases from a corresponding location of a dot light source towards two opposite ends along the central axial direction.

35. The illumination device as claimed in claim 34, wherein the distribution density of the openings are fixed along a second axial direction, and the projection of the central axial direction on the cover is substantially perpendicular to the second axial direction.

36. The illumination device as claimed in claim 30, $$p_i=(i/1)^{gamma}\times(h/2)|_{i=0-1},$$

wherein i is the normalized variable of the openings' arrangement number along the central axial direction, h is the spacing value of the dot light source, gamma is the locational modulation coefficient, and $p_i$ is the location of each corresponding opening and dot light source.

37. The illumination device as claimed in claim 30, wherein the cover is made of reflective diffusion material.

38. The illumination device as claimed in claim 30, wherein each of the dot light sources maintains a fixed distance relative to the cover.

39. The illumination device as claimed in claim 30, wherein the openings have the same size.

40. The illumination device as claimed in claim 30, wherein each of the covers have flexibility.

* * * * *